US007156271B2

(12) United States Patent
Louw

(10) Patent No.: US 7,156,271 B2
(45) Date of Patent: Jan. 2, 2007

(54) GARMENT HANGER END-CLIP HAVING A STOP MEMBER AND METHOD OF MANUFACTURE

(76) Inventor: Henry John Louw, Dreyersdal Road, Bergvliet 7800 (ZA)

( * ) Notice: Subject to any disclaimer, the term of this patent is extended or adjusted under 35 U.S.C. 154(b) by 214 days.

(21) Appl. No.: 10/666,978

(22) Filed: Sep. 17, 2003

(65) Prior Publication Data

US 2004/0173646 A1 Sep. 9, 2004

Related U.S. Application Data

(60) Provisional application No. 60/411,799, filed on Sep. 17, 2002, provisional application No. 60/411,798, filed on Sep. 17, 2002.

(51) Int. Cl.
*A41D 27/22* (2006.01)

(52) U.S. Cl. ..... 223/93; 223/96

(58) Field of Classification Search ..... 223/93, 223/85, 96, 90, 91, 94, 89
See application file for complete search history.

(56) References Cited

U.S. PATENT DOCUMENTS

| | | | |
|---|---|---|---|
| 549,145 | A | 11/1895 | Mickelson |
| 670,027 | A | 3/1901 | Malmberg |
| 928,086 | A | 7/1909 | Viganego |
| 1,081,058 | A | 12/1913 | Owens |
| 1,162,613 | A | 11/1915 | Kalina |
| 1,795,622 | A | 3/1931 | Taylor et al. |
| 1,893,508 | A | 1/1933 | Rosenberg |
| D146,998 | S | 6/1947 | Townsend et al. |
| 2,496,531 | A | 2/1950 | Gray |
| 2,524,537 | A | 10/1950 | Osmonson |
| 2,573,467 | A | 10/1951 | Macaluso |
| 2,583,784 | A | 1/1952 | MacCaferri |
| 2,802,610 | A | 8/1957 | DeLier |
| 2,883,095 | A | 4/1959 | Greenbaum |
| D186,716 | S | 7/1959 | Nalle, Jr. |
| 2,939,588 | A | 6/1960 | Nalle, Jr. |
| 3,235,928 | A | 2/1966 | Clark |
| D206,207 | S | 11/1966 | Stein |
| 3,292,223 | A | 12/1966 | Esposito, Jr. |

(Continued)

FOREIGN PATENT DOCUMENTS

| | | |
|---|---|---|
| AU | 1525492 | 12/1992 |

(Continued)

*Primary Examiner*—Rodney M. Lindsey
(74) *Attorney, Agent, or Firm*—Ostrolenk, Faber, Gerb & Soffen, LLP

(57) ABSTRACT

An end-clip for a garment hanger includes a bar having an end, and a connecting part with a first end and a second end. The connecting part is joined at the first end to and extends from the end of the bar. An arm is joined to the second end of the connecting part so that the arm extends over the bar and forms a space between the arm and the bar. An elongated pressing member is pivotally supported by the arm so that the pressing member is biased towards the bar by the arm and so that a part of the garment is receivable between the pressing member and the bar. The pressing member and the carrier member both have reinforced sections. A stop member is provided on at least one of the connecting part and the arm on a side facing the pressing member. The stop member is located above the pressing member at a distance so that the pressing member contacts the stop member when pivoted by inserting a garment between the pressing member and the bar.

23 Claims, 16 Drawing Sheets

U.S. PATENT DOCUMENTS

| | | | | |
|---|---|---|---|---|
| 3,593,897 | A | 7/1971 | Knox | |
| 3,767,092 | A | 10/1973 | Garrison et al. | |
| 3,946,915 | A | 3/1976 | Crane | |
| 3,950,829 | A | 4/1976 | Cohen | |
| 3,973,705 | A | 8/1976 | Erthein | |
| D243,138 | S | 1/1977 | Coon | |
| 4,009,807 | A | 3/1977 | Coon | |
| 4,023,721 | A | 5/1977 | Erthein | |
| 4,123,864 | A | 11/1978 | Batts et al. | |
| 4,335,838 | A | 6/1982 | Bisk et al. | |
| 4,382,531 | A | 5/1983 | Bisk et al. | |
| 4,629,102 | A | 12/1986 | Tendrup et al. | |
| 4,658,996 | A | 4/1987 | Warmath | |
| 4,660,750 | A | 4/1987 | Blanchard | |
| 4,706,347 | A | 11/1987 | Lindsay | |
| D296,729 | S | 7/1988 | Blanchard | |
| 4,759,480 | A | 7/1988 | Duester et al. | |
| 4,763,390 | A | 8/1988 | Rooz | |
| 4,802,265 | A | 2/1989 | Stevenson | |
| 4,828,155 | A | 5/1989 | Louw | |
| 4,892,237 | A * | 1/1990 | Duester et al. | 223/85 |
| 5,075,935 | A | 12/1991 | Abdi | |
| 5,082,153 | A | 1/1992 | Duester et al. | |
| 5,178,306 | A | 1/1993 | Petrou | |
| 5,212,854 | A | 5/1993 | Hollis | |
| 5,297,706 | A | 3/1994 | Blitz | |
| 5,350,092 | A | 9/1994 | Hollis | |
| 5,361,948 | A | 11/1994 | Batts | |
| 5,388,354 | A | 2/1995 | Marshall et al. | |
| 5,398,854 | A | 3/1995 | Blanchard | |
| 5,400,932 | A | 3/1995 | Hollis | |
| 5,516,014 | A | 5/1996 | Garrison | |
| 5,632,423 | A * | 5/1997 | Louw | 223/91 |
| D381,814 | S | 8/1997 | Louw | |
| 5,775,553 | A | 7/1998 | Marshall et al. | |
| 5,794,363 | A | 8/1998 | Marshall et al. | |
| 5,915,605 | A | 6/1999 | Blanchard | |
| 5,934,525 | A | 8/1999 | Blanchard | |
| 5,992,714 | A | 11/1999 | Morgan | |
| 6,019,261 | A | 2/2000 | Morgan et al. | |
| 6,021,933 | A | 2/2000 | Zuckerman | |
| 6,047,868 | A | 4/2000 | Petrou et al. | |
| 6,050,461 | A | 4/2000 | Batts et al. | |
| 6,357,638 | B1 | 3/2002 | Gouldson | |
| 6,516,980 | B1 * | 2/2003 | Goldman | 223/85 |
| 6,715,650 | B1 * | 4/2004 | Gouldson | 223/93 |
| 2001/0015361 | A1 * | 8/2001 | Gouldson | 223/85 |
| 2002/0113100 | A1 | 8/2002 | Gouldson | |
| 2003/0015485 | A1 | 1/2003 | Gouldson | |
| 2004/0173646 | A1 * | 9/2004 | Louw | 223/93 |
| 2005/0067447 | A1 * | 3/2005 | Louw | 223/96 |

FOREIGN PATENT DOCUMENTS

| | | | |
|---|---|---|---|
| EP | 374329 | A1 * | 6/1990 |

* cited by examiner

GARMENT HANGER END-CLIP HAVING A STOP MEMBER AND METHOD OF MANUFACTURE

CLAIM FOR PRIORITY

This application is related to and claims priority of U.S. Provisional Application Ser. Nos. 60,411,798, filed Sep. 17, 2002 and 60,411,799, filed Sep. 17, 2002.

BACKGROUND OF THE INVENTION

The present invention relates to garment hangers and more particularly to end-clips for garment hangers which can include a retention means or stop member which allows for improved retention of garments such as undergarments, e.g., bras and underpants.

Examples of garment hangers that can be used with the present invention include, but are not limited to, those shown and described in U.S. Pat. Nos. 4,629,102, 4,828,155, 5,632,423 and 6,357,638. The disclosures of these patents are incorporated by reference herein. In these hangers, for example , the strap of a bra is secured in the hanger end-clip between a pressing member and an elongated bar portion of the hanger.

Referring now to FIG. 1 which shows an end-clip 16 of a hanger, a problem of the hangers discussed above is that the strap of a garment can get caught in area A near a pressing member 18. To solve that problem, U.S. Pat. No. 5,632,423, for example, inserted a stop formation 38 to be substantially aligned with pressing member 18 so that when a garment strap is inserted in the hanger in an area 32 between pressing member 18 and an elongated bar portion 14 of the hanger, the stop formation 38 blocked the garment strap from traveling into area A.

Thus, as evidenced by U.S. Pat. No. 5,632,423, it is desirable to have a hanger that can accommodate both thick and thin garments, as well as a variety of materials, and in addition, which can retain these garments in their proper position once arranged on the hanger.

U.S. Pat. No. 6,357,638 claims a stop formation that is not located substantially adjacent to the end of the pressing member. The patent further claims instead, that the stop formation is located above the inner arm, along the trajectory of the outer end of the inner arm, so as to block access along a predetermined path or trajectory described by the end of the inner arm, as it flexes upwardly in response to the presence of a narrow strap. The patent goes on to claim that by moving the stop formation upwardly, they block access to the inner space when the inner arm is flexed upwardly.

SUMMARY OF THE INVENTION

It is therefore an object of the present invention to provide a garment hanger having a gripping mechanism, as well as an optional stop member for retaining the garment in a desired position within the gripping mechanism.

The garment hanger has garment support means which are located at the ends of a bar which includes a means for suspending the bar from a support or rack. The garment support means or clip include a connecting part, an arm, a carrier element, and an elongated stiff pressing member. The connecting part is joined at one end to the bar and at the other end to the arm which extends in a direction towards the center of the bar. The arm has a free end which forms a space between the arm and the bar. The carrier element is located at the end of the arm away from the connecting part on the side which faces towards the bar. The elongated stiff pressing member is supported by the carrier element so that the pressing member is biased towards the bar by the arm and so that a part of a garment is receivable in between the pressing member and the bar. In addition, the pressing member is generally in the form of an elongated beam which is substantially, centrally and pivotally supported by the free end of the associated carrier element. Finally, the part which is of reduced width in relation to the connecting part is located on the side of the connecting part which faces toward the carrier element. This part of reduced width crosses the part to bias the carrier element and the pressing member toward the bar during post-loading shrinkage. This reduced with part results in an increase in the tension of the garment due to decrease in the space between the bar and the pressing member. The pressing member and the carrier element have selectively strengthened locations.

The garment support means can further include a stop member which is positioned on the connection part of the arm on the side facing the pressing member. This stop member maintains the position of the garment between the pressing member and the bar by preventing the garment from moving around the end of the pressing member into the space between the pressing member and the bar.

Other features and advantages of the present invention will be apparent from the following description of the invention which refers to the accompanying drawings.

BRIEF DESCRIPTION OF THE DRAWINGS

The invention will now be described by way of example with reference to the accompanying schematic drawings.

DETAILED DESCRIPTION OF THE EMBODIMENTS

Referring to FIGS. 2–7, an exemplary end-clip 56 is shown which is attached to the ends of a bar 54 of a garment hanger. The end-clip 56 includes a stop formation 50 according to the present invention. It should be realized by those skilled in the art that the stop member of the present invention can be used in connection with any other end-clip formation including, but not limited to, the exemplary end-clips shown in FIGS. 3, 4, 7 and 15.

Figure 1:
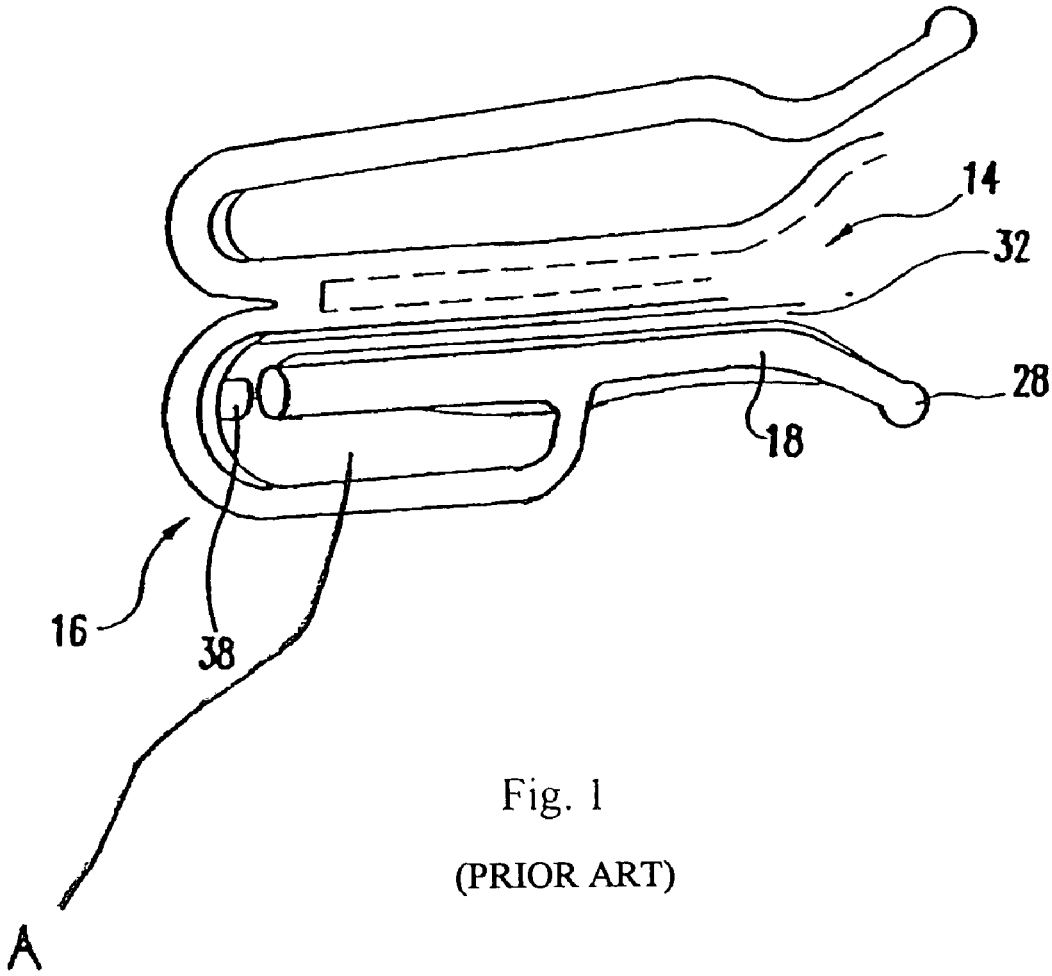
Fig. 1 (PRIOR ART)
FIG. 1 is a detailed diagram of a prior art garment support means at one end of the bar of a garment hanger.
Figure 2:
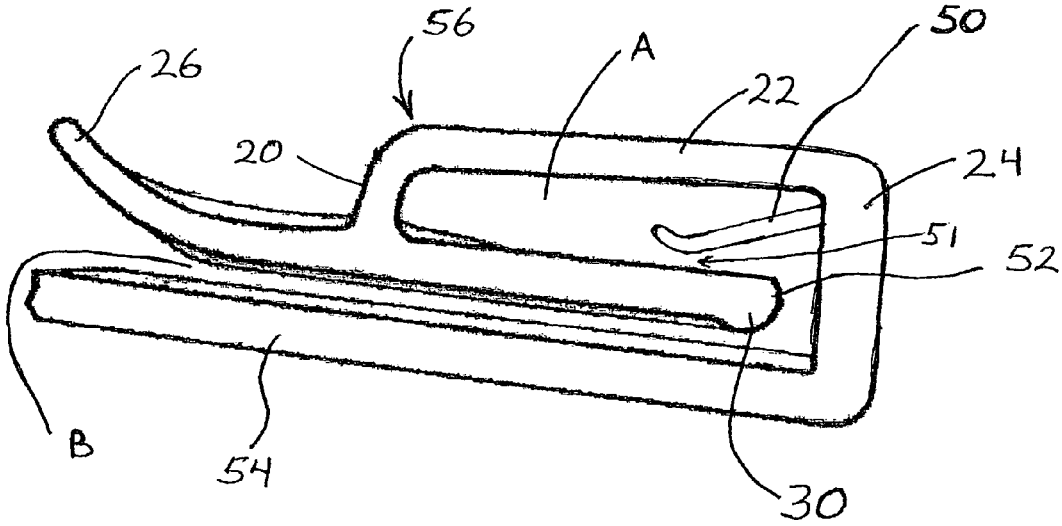
FIG. 2 is a detailed diagram of garment support means pursuant to the present invention.

The end-clip or support means 56 includes a stiff garment pressing member 52. In FIG. 2, the pressing member 52 is substantially centrally supported by a carrier 20. The carrier 20 is joined by a spring arm 22 which ends in a laterally directed connecting part 24 which in turn is joined to the bar 54.

The pressing member 52 has an outwardly curved end 26 and at its opposite end terminates into an at least partially curved head 30. A gap or area B for inserting a garment is defined between the pressing member 52 and the bar 54.

The stop member 50 is provided on the inside face of the connecting part 24. As shown in FIG. 2, the stop member 50 is located above the pressing member 52. The stop member 50 is arranged so that when the garment is inserted into the area B, the pressing member 52 abuts against the stop member 50 to completely block access of a garment into the area A. This can be seen more clearly in FIGS. 5, 6, 6A, 6B and 7, in which the dashed lines show how different end-clips operate when a garment is inserted into the area B. As can be seen in these figures, when pressing member 52 abuts against stop member 50 when a garment is inserted into area B, the garment is blocked by pressing member 52 and the junction area 51 between pressing member 52 and the stop formation 50. This prevents a thin garment, such as a thin garment strap from traveling into area A. With some of the prior art end-clips, where a tip of the pressing member aligns with, but does not abut, the stop formation after the garment is inserted in the end-clip, a thin strap may still tend to slip into area A if there is a large enough gap between the pressing member and the stop formation.

As stated previously, it is preferred that the pressing member 52 is stiff, but pivotable about the carrier 20. The arm 22 and the connecting part 24 are flexible so that a spring effect is produced. In other words, if pressure is applied on the pressing member 52 when inserting a garment, the gap B widens, the pressing member 52 pivots about the carrier 20 according to the position of the force applied on it and the arm 22 and connecting part 24 flex to allow the gap B to widen as is required.

As shown in FIG. 2, the stop member 50 is a cantilever member that extends at an angle from the connecting part 24 downward toward the pressing member 52. The distal end of the stop member 50 which is nearest the pressing member 52 is curved upwardly so as to provide a rounded surface for engagement with the processing member 52.

The stop member 50 can be made of any material, e.g., a rigid or flexible plastic material, so long as it acts in conjunction with the pressing member 52 to prevent the strap of a garment, for example, from traveling into area A. Preferably, the stop member 50 is made of a resilient or spring-like material so that when a garment is inserted into area B and the pressing member 52 abuts against the stop member 50, the stop member 50 exerts a force towards the pressing member 52 to more securely retain the garment in the area B between the pressing member 52 and the bar 54.

Figure 3:
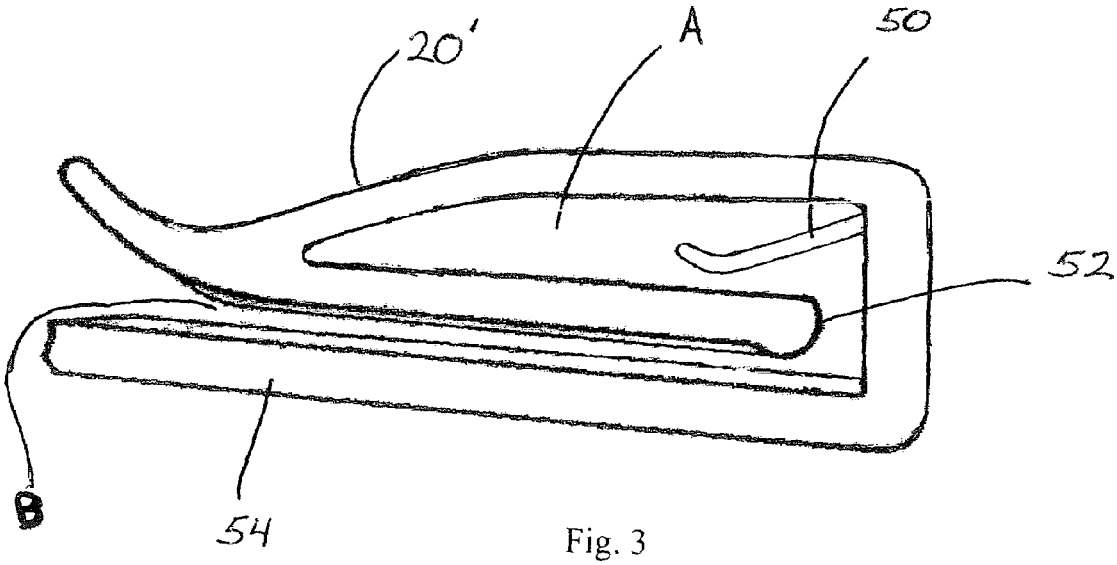
FIGS. 3 and 4 show various embodiments of garment support means which can be provided at the end of a garment hanger bar; and a use condition.
Figure 7:
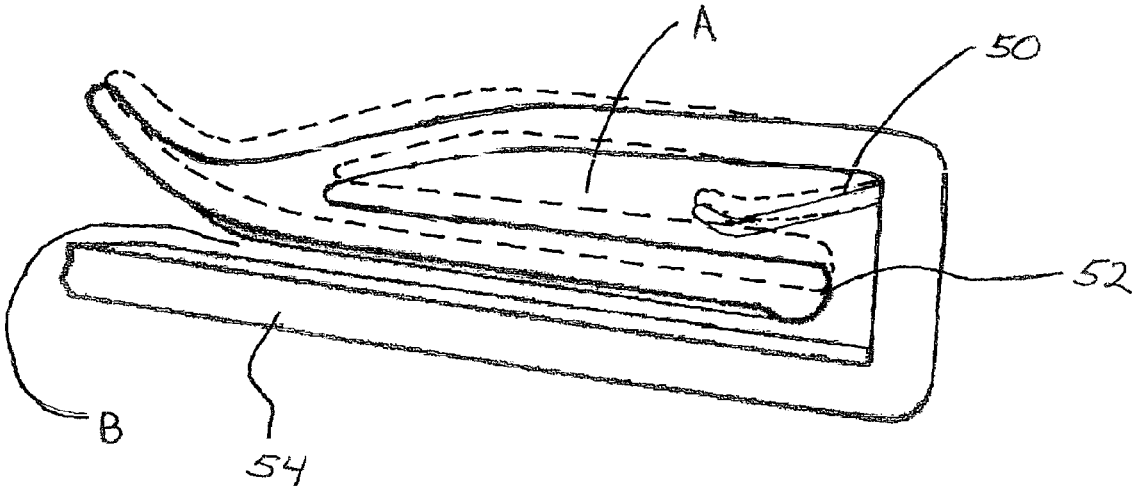
FIG. 7 is a view as in FIG. 5 of the embodiment in FIG. 3.

The exemplary embodiment shown in FIG. 3 functions in substantially the same fashion as the embodiment of FIG. 2. In FIG. 3, however, the carrier 20' has a curved shape. FIG. 7 shows the clip of FIG. 3 in a rest condition shown in solid lines and a condition in which a garment is inserted in the gap B so that the pressing member 52 is pushed upward so as to engage the stop member 50.

Figure 4:
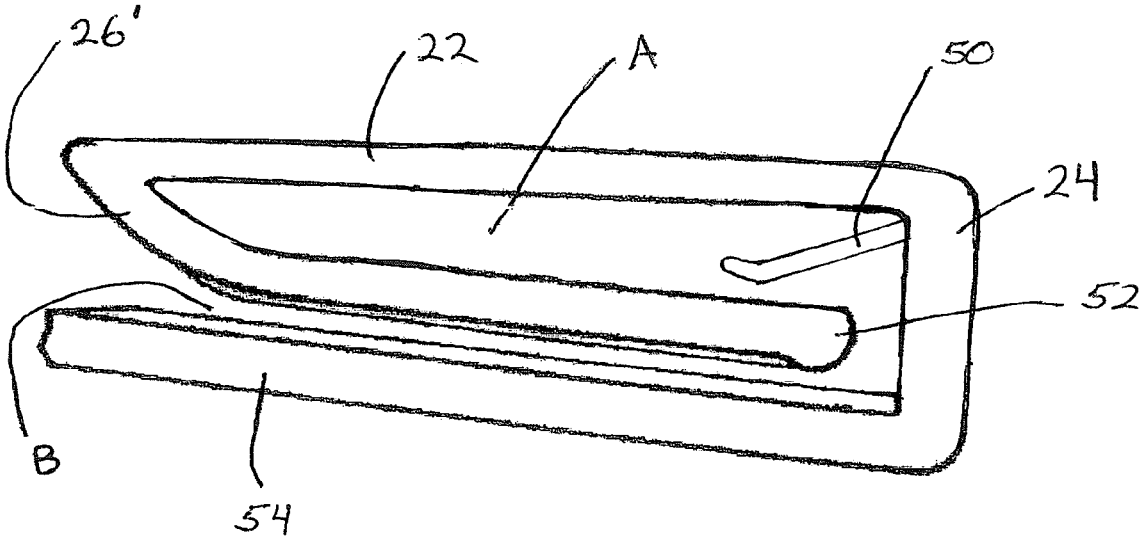
Figure 5:
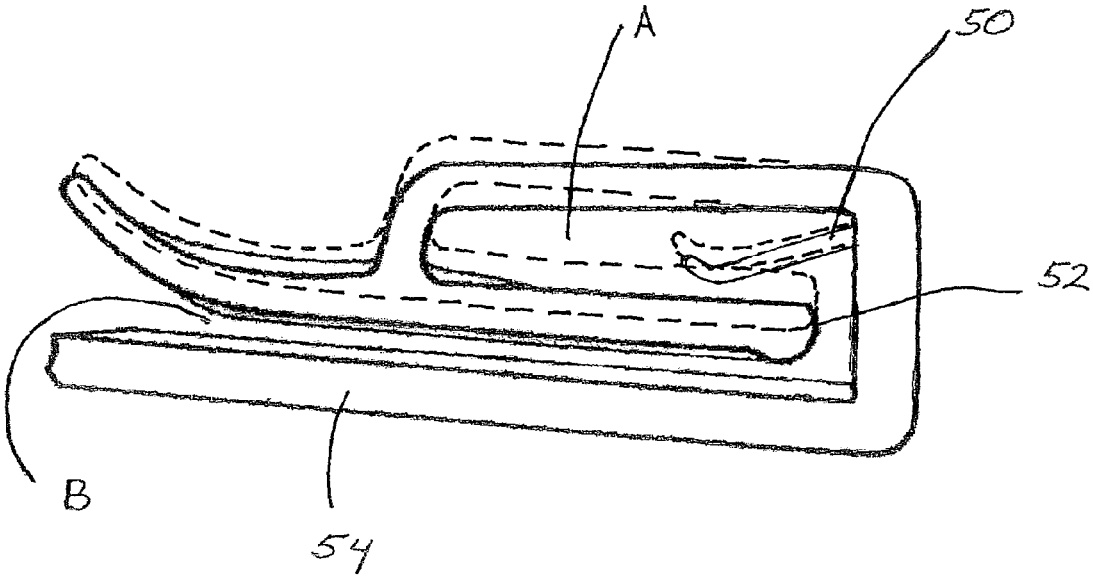
FIG. 5 shows the embodiment of FIG. 2 in a rest condition and a use condition.
Figure 6A:
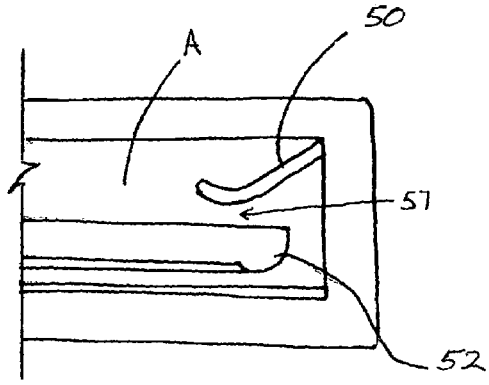
FIGS. 6A and 6B are detailed views of FIG. 6 showing the stop member in the rest condition and the use condition.
Figure 6:
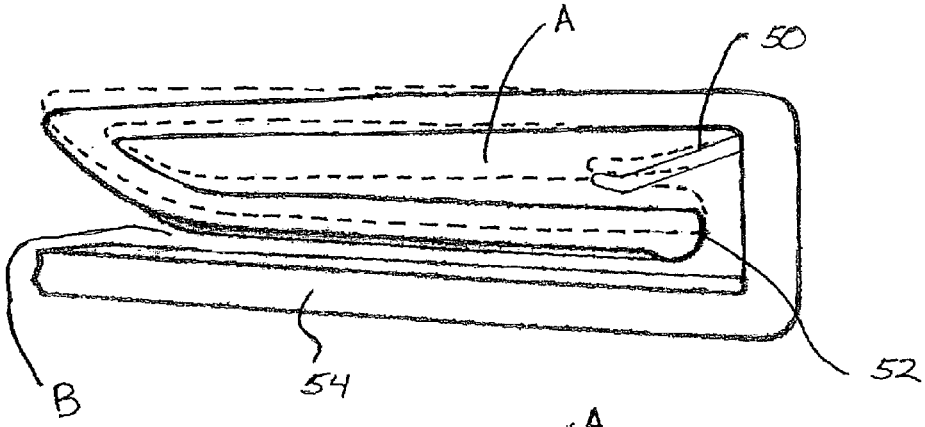
FIG. 6 is a view as in FIG. 5 of the embodiment in FIG. 4.
Figure 6B:
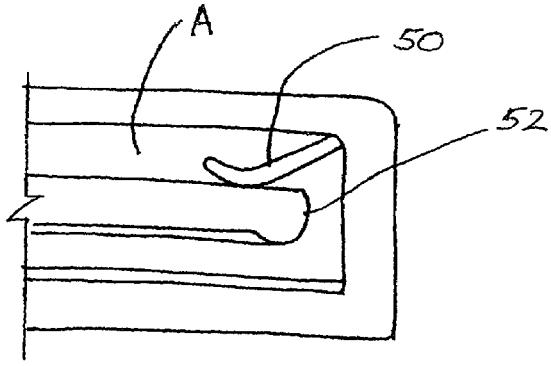

FIG. 4 shows yet another exemplary embodiment of an end-clip in which the curved end 26' of the pressing member 52 is connected to the end of the spring arm 22 opposite the connecting part 24. FIG. 6 shows in dashed lines the position of the pressing member 52 when a garment is inserted in the gap B. Furthermore, FIG. 6A shows the initial, rest position of the free end of the pressing member 52 and FIG. 6B shows the use condition in which the pressing member 52 is in contact with the stop member 50.

From the above embodiments it is thus apparent that the stop member 50 can be used in connection with a wide variety of end-clips which can have varying configurations.

Figure 8:
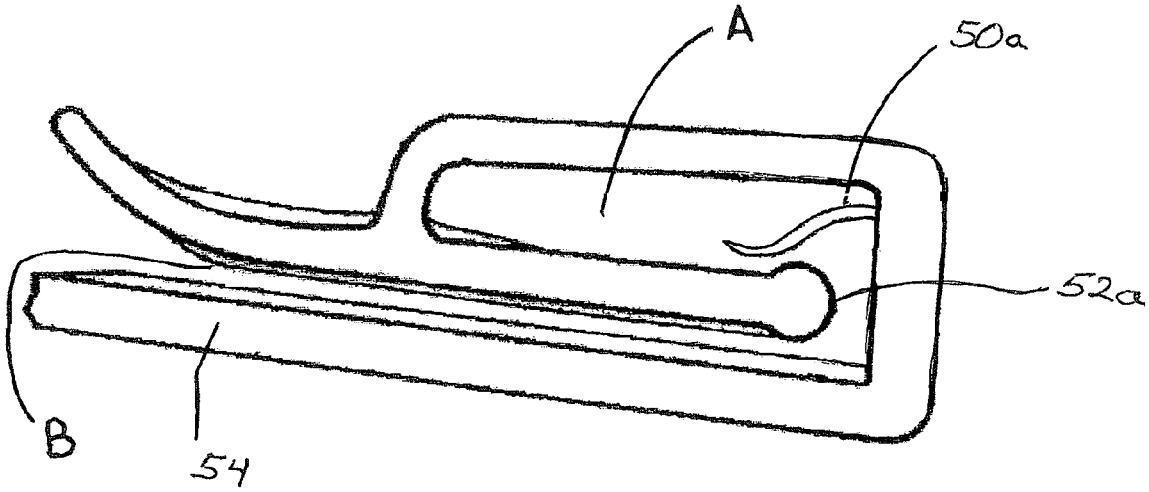
FIGS. 8–14 show various embodiments of the stop member which can be provided on the garment support clip.

Additionally, the stop member itself can have various configurations which fulfill the objectives of the invention. See the exemplary embodiments of FIGS. 8–14. As shown in FIG. 8, the stop member 50*a* has a wave-shape. To facilitate contact with the stop member 50*a*, the pressing member 52*a* at its free end has a rounded head, as opposed to the partially rounded head shown in FIGS. 1–7.

Figure 9:
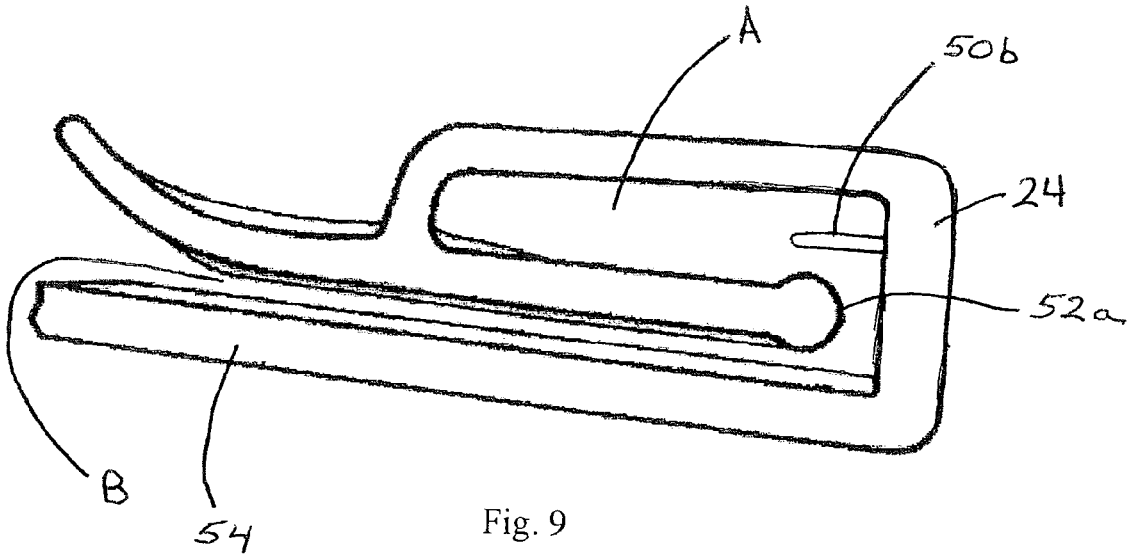

In FIG. 9, the stop member 50*b* projects substantially perpendicularly from the connecting part 24. The stop member 50*b* is arranged at a distance from the pressing member 52*a* so that when a garment is inserted the curved head of the pressing member 52*a* contacts and presses against the stop member 50*b*.

Figure 10:
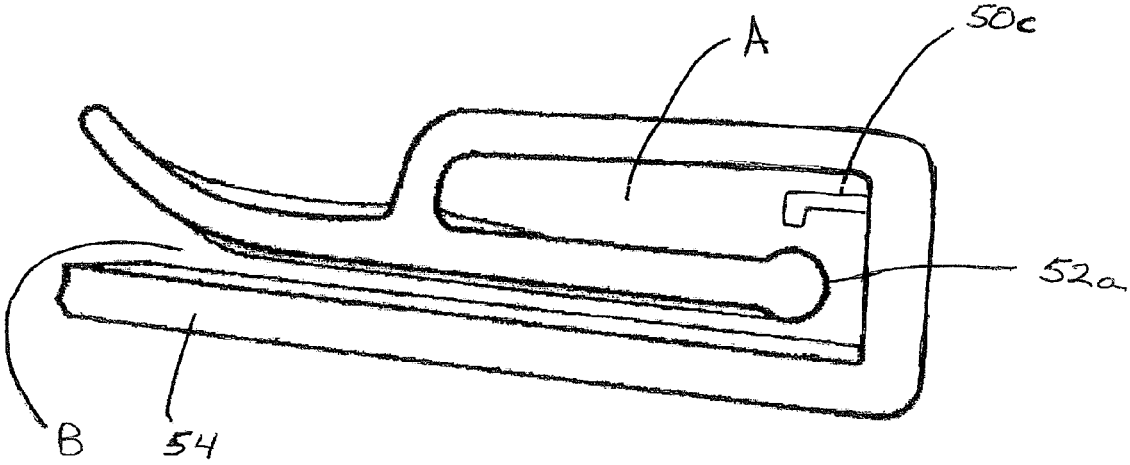

The embodiment in FIG. 10 shows a stop member 50*c* which has a downwardly directed element at its free end for contact with the curved head of the pressing member 52*a*.

Figure 11:
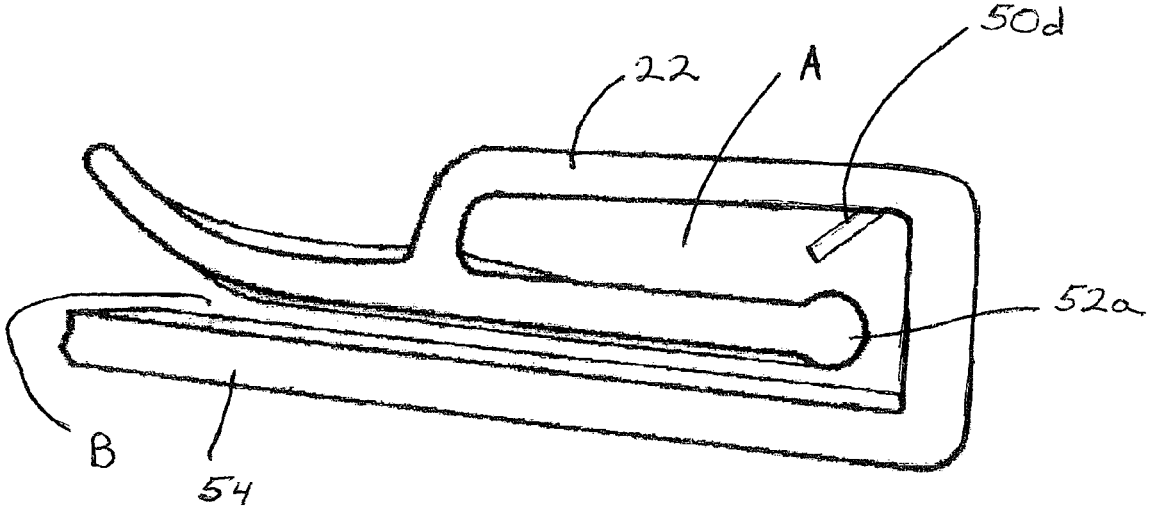

In FIG. 11, the stop member projects downwardly at an angle from the spring arm 22 rather than from the connecting part 24. The stop member 50*d* is angled and of a length so that the curved head of the pressing member 52*a* contacts the stop member 50*d* when a garment is inserted in area B.

Figure 12:
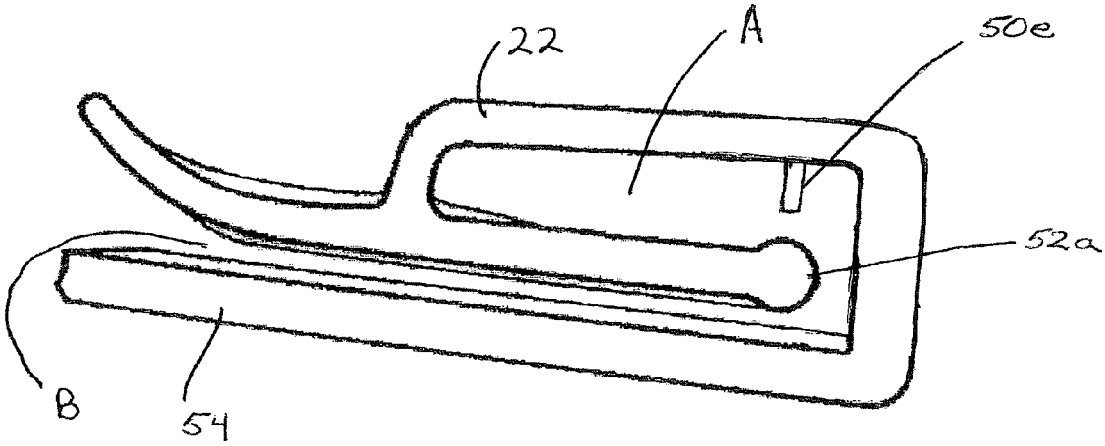

A stop member 50*e* in FIG. 12 projects perpendicularly, downwardly from the spring arm 22 so that the curved head of the pressing member 52*a* engages the end surface of the stop member 50*e*.

Figure 13:
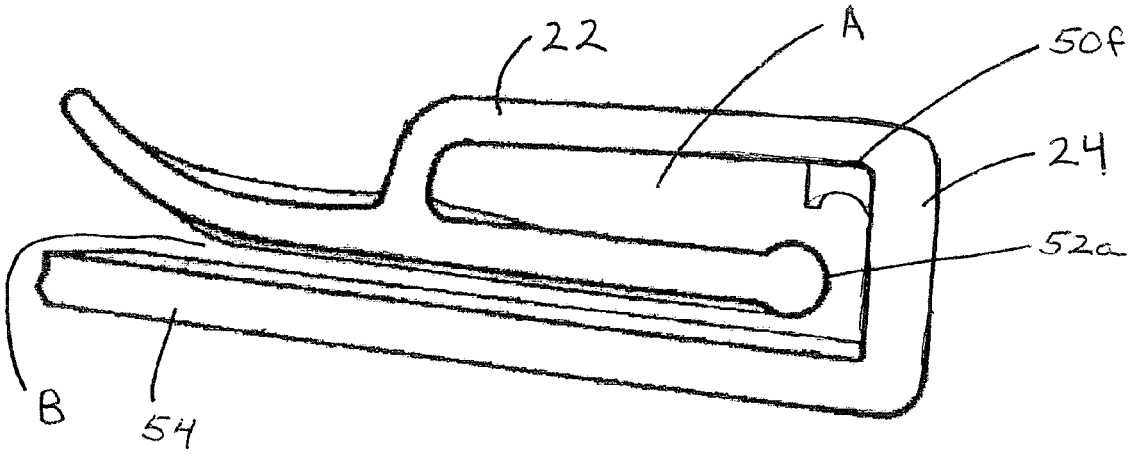

In FIG. 13, there is shown a stop member 50*f* which is arranged in the corner formed by the spring arm 22 and the connecting part 24. The stop member 50*f* is shaped so that the curved head of the pressing member 52*a* contacts at least a portion of the stop member 50*f* to prevent passage of a garment strap to the area A.

Figure 14:
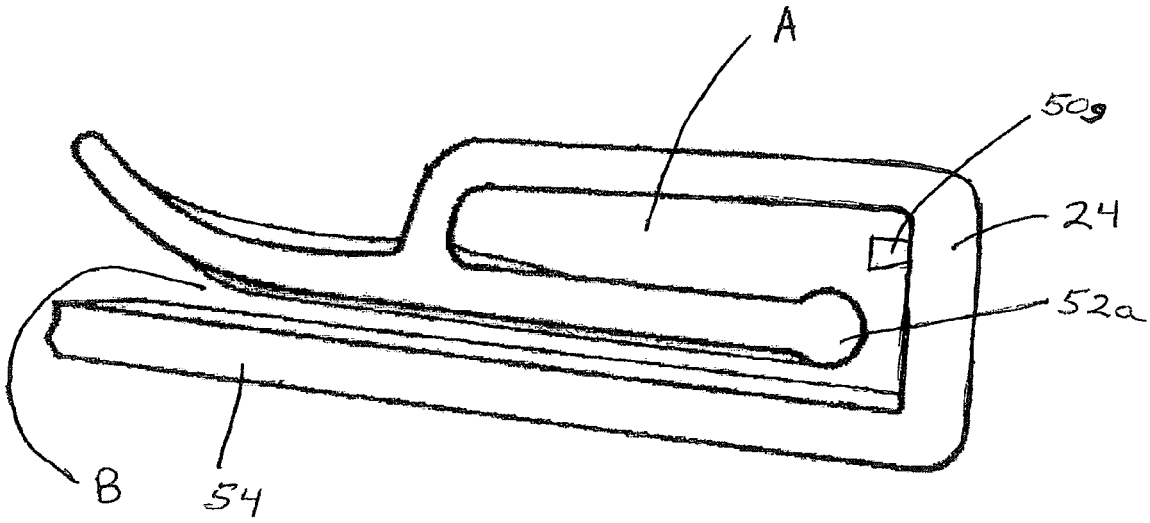
Figure 15:
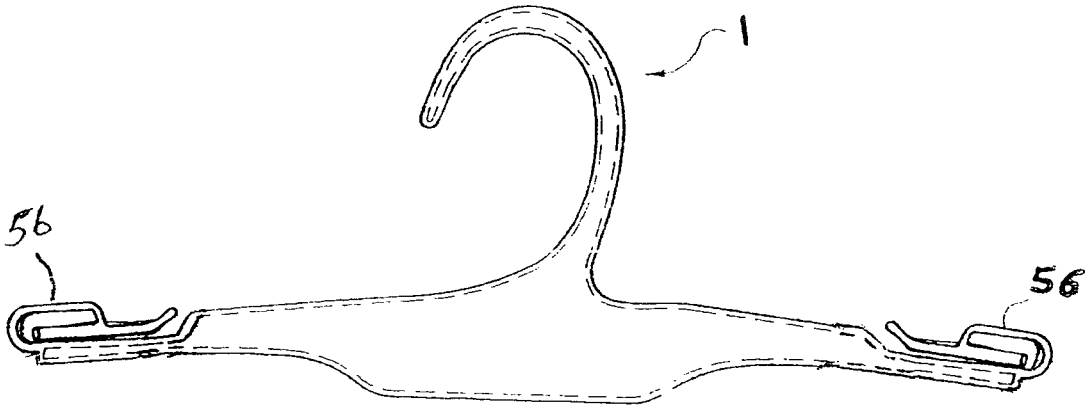
FIG. 15 is a front view of a garment hanger with an end-clip that can be used in accordance with the present invention.

Stop member 50*g* illustrated in FIG. 14 projects laterally from the connecting part 24 and is shaped so as to have a thickness that increases toward the distal end of the stop member 50*g*. The stop member 50*g* is shaped and arranged so that the curved head of the pressing member 52*a* is contactable therewith when a garment is inserted in area B.

In all of the exemplary embodiments shown in FIGS. 8–14, the stop member 50*a*–*g* works in conjunction with the pressing member 52 to block access to the area A after a garment has been inserted in the area B.

Figure 16:
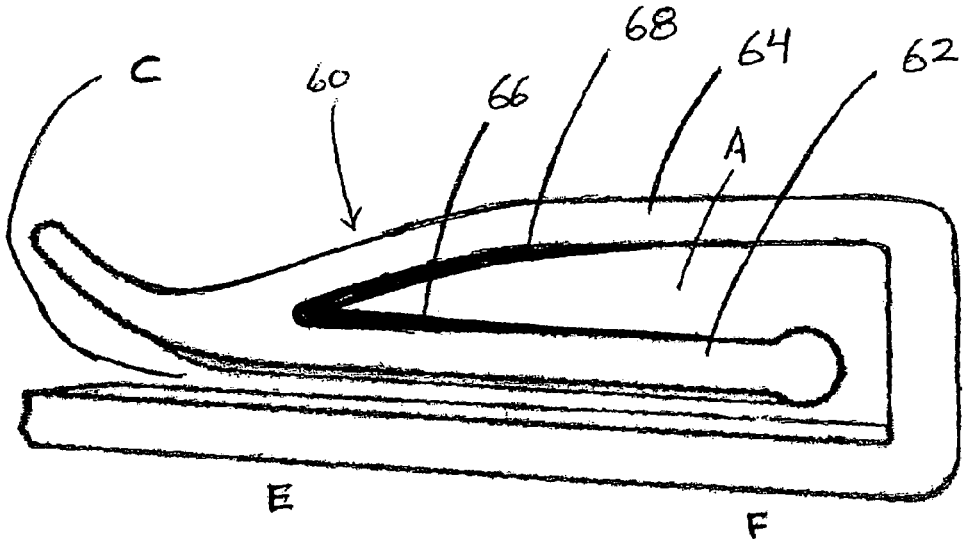
FIG. 16 shows another embodiment of an end-clip without a stop member and with reinforced or thickened elements.

Referring now to FIG. 16, an end-clip 60 is shown which has a pressing member 62 and a carrier 64. To this extent, the clip is similar to that shown in FIG. 2. However, in the embodiment in FIG. 16, the pressing member 62 and the carrier 64 are selectively strengthened at locations 66, 68 by methods known in the art. These strengthened locations are on the surfaces of the pressing member 62 and the carrier 64 which bound the space A within the clip. As shown in FIG. 16, the strengthened locations are in the region of the corner between the pressing member 62 and the carrier 64. The strengthening can be done, for example, by thickening the plastic of the members as required. This thickening balances the amount of pressure applied at the points E and F when a garment is inserted into the area C. This encourages the pressing member 62 to be more effective at its weakest end F.

Although shown without a stop arrangement, it is possible to add a stop arrangement in the embodiment of FIG. 16, if desired.

Although the present invention has been described in relation to particular embodiments thereof, many other variations and modifications and other uses will become apparent to those skilled in the art.

What I claim is:

1. An end-clip for a garment hanger, comprising:

a bar having an end;

a connecting part with a first end and a second end, the connecting part being joined at the first end to and extending from the end of the bar;

an arm joined to the second end of the connecting part so that the arm extends over the bar and forms a space between the arm and the bar, the arm having an end;

an elongated pressing member carried by the arm so that the pressing member is biased towards the bar by the arm and so that at least a part of a garment is receivable between the pressing member and the bar; and a stop member in the form of an elongated cantilever that has a free end and an opposing end, the opposing end being connected to at least one of the connecting part and the arm on a side facing the pressing member, the stop member being located at least partially above the pressing member at a sufficient distance so that the pressing member contacts the stop member when a garment is inserted between the pressing member and the bar.

2. An end-clip as recited in claim 1, wherein the stop member extends from the side of the connecting part at an angle downwardly toward the pressing member.

3. An end-clip as recited in claim 2, wherein the free end of the stop member is curved upwardly so as to form a rounded contact surface directed toward the pressing member.

4. An end-clip as recited in claim 1, wherein the stop member has a wave shape and projects from the side of the connecting part, the wave shape being such that the free end of the stop member is closer to the pressing member than the opposing end of the stop member which is mounted to the connecting part.

5. An end-clip as recited in claim 1, wherein the stop member extends downwardly at an angle from the arm.

6. An end-clip as recited in claim 5, wherein the stop member extends from the arm at an angle of substantially 90°.

7. An end-clip as recited in claim 1, wherein the stop member is provided in a corner formed by the arm and the connecting part.

8. An end-clip as recited in claim 1, and further comprising a carrier element located at the end of the arm away from the connecting part on a side thereof facing the bar, the pressing member being substantially centrally and pivotally supported by a free end of the carrier element.

9. An end-clip as recited in claim 1, and further comprising a carrier element located at the end of the arm away from the connecting part on a side thereof facing the bar, the pressing member being supported by the carrier element in a region of an end of the pressing member distal the connecting part.

10. An end-clip as recited in claim 1, wherein the pressing member has an end proximal the connecting part and an end distal the connecting part, the distal end of the pressing member being connected to the end of the arm.

11. An end-clip as recited in claim 1 wherein the stop member is made of a resilient material.

12. An end-clip as recited in claim 11, wherein the stop member is made of plastic.

13. An end-clip for a garment hanger, comprising:

a bar having an end;

a connecting part with a first end and a second end, the connecting part being joined at the first end to and extending from the end of the bar;

an arm joined to the second end of the connecting part so that the arm extends over the bar and forms a space between the arm and the bar, the arm having an end;

an elongated pressing member carried by the arm so that the pressing member is biased towards the bar by the arm and so that at least a part of a garment is receivable between the pressing member and the bar; and a stop member on at least one of the connecting part and the arm on a side facing the pressing member, the stop member being located at least partially above the pressing member at a sufficient distance so that the pressing member contacts the stop member when a garment is inserted between the pressing member and the bar;

wherein the stop member is a cantilevered member that projects laterally from the connecting part.

14. An end-clip as recited in claim 13, wherein a free end of the cantilevered member has a downwardly angled portion arranged to be engageable with the pressing member.

15. An end-clip for a garment hanger, comprising:

a bar having an end;

a connecting part with a first end and a second end, the connecting part being joined at the first end to and extending from the end of the bar;

an arm joined to the second end of the connecting part so that the arm extends over the bar and forms a space between the arm and the bar, the arm having an end;

an elongated pressing member carried by the arm so that the pressing member is biased towards the bar by the arm and so that at least a part of a garment is receivable between the pressing member and the bar; and a stop member on at least one of the connecting part and the arm on a side facing the pressing member, the stop member being located at least partially above the pressing member at a sufficient distance so that the pressing member contacts the stop member when a garment is inserted between the pressing member and the bar;

wherein the stop member projects laterally from the connecting part and has a thickness that increases from a proximal end attached to the connecting part to a free, distal end.

16. A garment hanger, comprising:

an elongated bar having two opposite ends;

suspension means for suspending the bar from a support; and an end-clip at each of the opposite ends of the bar for supporting garments from the hanger, each of the end-clips including;

a connecting part with a first end and a second end, the connecting part being joined at the first end to and extending from the end of the bar;

an arm joined to the second end of the connecting part so that the arm extends over the bar and forming a space between the arm and the bar;

an elongated pressing member carried by the arm so that the pressing member is biased towards the bar by the arm and so that a part of a garment is receivable between the pressing member and the bar, the pressing member being formed as an elongated beam pivotally supported by the arm; and a stop member on at least one of the connecting part and the arm on a side facing the pressing member, the stop member being located above the pressing member at a distance so that the pressing member contacts the stop member when a garment is inserted between the pressing member and the bar;

wherein the stop member is resilient so as to flex and exert a counter force against the pressing member when the pressing member contacts the stop member when the garment is inserted between the pressing member and the bar.

17. An end-clip for a garment hanger, comprising:

a bar having an end;

a connecting part with a first end and a second end, the connecting part being joined at the first end to and extending from the end of the bar;

an arm with a first end and a second end, the first end of the arm being joined to the second end of the connecting part so that the arm extends over the bar and forms a space between the arm and the bar;

a carrier member joined to the second end of the arm; and an elongated pressing member connected to and supported by the carrier member so that the pressing member is biased towards the bar by the arm and so that a part of a garment is receivable between the pressing member and the bar;

wherein the carrier member and the pressing member each increases in width towards the connection between the pressing member and the carrier member, the increased width of the carrier member and the pressing member providing reinforcement.

18. An end-clip as recited in claim 17, wherein the increased width of the carrier member and the pressing member balances pressure applied by the pressing member along its length when a garment is inserted between the bar and the pressing member.

19. An end-clip as recited in claim 17, wherein the pressing member and the carrier member are made of plastic.

20. An end-clip as recited in claim 19, wherein the increased width of the carrier member and the pressing member are formed by thickened portions of the plastic.

21. An end-clip as recited in claim 17, and further comprising a stop member on at least one of the connecting part and the arm on a side facing the pressing member, the stop member being located above the pressing member at a distance so that the pressing member contacts the stop member when pivoted by inserting a garment between the pressing member and the bar.

22. A garment hanger comprising:

an elongated bar having two opposite ends;

suspension means for suspending the bar from a support; and a garment clip at each of the opposite ends of the bar for supporting garments from the hanger, each of the garment clips including;

a connecting part with a first end and a second end, the connecting part being joined at the first end to and extending from the end of the bar;

an arm with a first end and a second end, the first end of the arm being joined to the second end of the connecting part so that the arm extends over the bar and forms a space between the arm and the bar;

a carrier member joined to the second end of the arm; and an elongated pressing member connected to and pivotally supported by the carrier member so that the pressing member is biased towards the bar by the arm and so that a part of a garment is receivable between the pressing member and the bar, the pressing member being formed as an elongated beam;

wherein the carrier member and the pressing member each increases in width towards the connection between the pressing member and the carrier member, the increased width of the carrier member and the pressing member providing reinforcement.

23. A garment clip as recited in claim 22, and further comprising a stop member on at least one of the connecting part and the arm on a side facing the pressing member, the stop member being located above the pressing member at a distance so that the pressing member contacts the stop member when pivoted by inserting a garment between the pressing member and the bar.

* * * * *